US009821525B2

(12) United States Patent
Meissner et al.

(10) Patent No.: US 9,821,525 B2
(45) Date of Patent: Nov. 21, 2017

(54) COMPRESSION PUNCH FOR A ROTARY PRESS

(75) Inventors: Friedrich Meissner, Hamburg (DE); Stefan Luedemann, Hamburg (DE); Jan Naeve, Kahrsen (DE)

(73) Assignee: FETTE GMBH, Schwarzenbek (DE)

( * ) Notice: Subject to any disclaimer, the term of this patent is extended or adjusted under 35 U.S.C. 154(b) by 1983 days.

(21) Appl. No.: 12/820,942

(22) Filed: Jun. 22, 2010

(65) Prior Publication Data

US 2011/0000272 A1 Jan. 6, 2011

(30) Foreign Application Priority Data

Jul. 2, 2009 (DE) ..... 10 2009 031 367

(51) Int. Cl.
*B30B 11/08* (2006.01)
*B30B 15/06* (2006.01)

(52) U.S. Cl.
CPC ..... *B30B 11/08* (2013.01); *B30B 15/065* (2013.01)

(58) Field of Classification Search
USPC .... 425/345, 470, 78, 352–355; 72/324, 325, 72/462, 464, 476, 355.4, 470, 472
See application file for complete search history.

(56) References Cited

U.S. PATENT DOCUMENTS 5,699,273 A * 12/1997 Hinzpeter et al. ..... 702/105
6,056,532 A * 5/2000 Pagel ..... 425/345
2007/0087073 A1* 4/2007 Chowdhury et al. ..... 425/408
2009/0252823 A1 10/2009 Meissner et al.
2009/0269433 A1* 10/2009 Schikowski et al. ..... 425/470

FOREIGN PATENT DOCUMENTS

DE 81 11 860 U 9/1981
DE 10 2007 043 582 B3 11/2008
JP H05 84277 A 4/1993
JP 2003106111 A * 4/2003

OTHER PUBLICATIONS

ISO 18084:2005, press tools for tablets—punches and dies, Oct. 1, 2005, first edition, p. 1, p. 2, p. 13.*

* cited by examiner

*Primary Examiner* — Sunil K Singh
*Assistant Examiner* — Chwen-Wei Su
(74) *Attorney, Agent, or Firm* — Vidas Arrett & Steinkraus

(57) ABSTRACT

A compression punch for a rotary press, with a shaft, a punch head disposed at one shaft end and a compression zone disposed at the other shaft end, wherein the punch head features an upper mirror surface, an outer cylinder surface and a curved transition zone between the mirror surface and the cylinder surface, wherein the mirror surface and the transition zone form a three-dimensional surface, whose course in at least one radial direction can be described by a mathematical function whose second derivative is continuous.

7 Claims, 1 Drawing Sheet

COMPRESSION PUNCH FOR A ROTARY PRESS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention is related to a compression punch for a rotary press, with a shaft, a punch head disposed at one shaft end and a compression zone disposed at the other shaft end, wherein the punch head features an upper mirror surface, an outer cylinder surface and a curved transition zone between the mirror surface and the cylinder surface. Rotary presses for the production of tablets and similar pressed articles feature lower and upper punches, which co-operate with die bores in a die plate in order to process powder filled in to pressed articles. The moulds with which the punches co-operate are designated as dies, which are fixed as separate sleeve-like inserts in bores of the die plate. In the rotary presses, such compressions punches are used which have a shaft at whose one end is disposed a punch head, and at the other end a compression zone which co-operates with the die bores in order to compress the powder. On its upper side, the punch head has a usually planar mirror surface which co-operates with compression rollers of the rotary press. The diameter of the mirror surface determines the pressure hold time of the compression punches, i.e. at given speed the time duration in which the compression punches interact with the powder to be compressed. The punch heads have a cylinder surface in addition and a transition zone that is disposed between the cylinder surface and the mirror surface and usually rounded. Known punch heads are designed with geometrically defined radii and straight lines. At their lower side, the punch heads verge into the shaft in an e.g. conical zone. The geometric shape and dimensions of punch heads for rotary presses are standardised by DIN ISO 18084:2006-09, which is hereby incorporated by reference in its entirety. However, with known punch heads there is a significant noise emission and a wear on punches and compression rollers in the course of the interaction between the compression rollers and the punch heads. The punch head in particular experiences increased wear at the transition to the mirror surface. Moreover, in the state of the art, just with smaller punch formats the pressure hold times are relatively small, so that materials that are compressible only with difficulty may pose a problem. Finally, increased vibrations of the machine stand take place under certain conditions of operation in the state of the art, leading also to increased emission of noise. In DE 10 2007 043 582 B3, the entire contents of which are hereby incorporated by reference, it is proposed to provide punch heads with chamfers at opposing sides, so that the same may be positioned at smaller distances from each other. This improves the interaction with the compression rollers.

Starting from the explained state of the art, the present invention is based on the objective to provide a compression punch of the kind mentioned in the beginning, wherein the noise emission in the operation is reduced and the wear of the punch heads and the compression rollers is reduced further.

BRIEF SUMMARY OF THE INVENTION

The present invention resolves this problem by the subject matter of claim 1. Advantageous embodiments will be found in the dependent claims, the description and the figures.

For a compression punch of the kind mentioned in the beginning, the present invention resolves the objective in that the mirror surface and the transition zone form a three-dimensional surface whose course in at least one radial direction can be described by a mathematical function whose second derivative is continuous. In this, the mirror surface may be flat and may be shaped circular in the top view. Together with the transition zone, it forms a curved surface of the punch head, wherein the transition zone runs out directly into the mirror surface. The height of the punch head decreases in particular from the mirror surface to the cylinder surface continuously. According to the present invention, it has been found that the noise emission and the wear occurring in the state of the art are caused by an unfavourable, in particular non-uniform interaction between the compression rollers and the punch heads. The reason of this is that the transition zone itself, and its run-out into the mirror surface in particular, feature sudden changes of radius. The transition from the outer radii of the transition zone into the mirror surface is therefore non-uniform. Through this arises an also non-uniform contact with the compression rollers, and therefore high noise emission and wear.

According to the present invention, the course of the upper side of the punch head in at least one radial direction is described by a mathematical function that is continuous in its second derivative. The at least one radial direction may be that direction in particular, in which the compression rollers act on the punch heads. Thus, according to the present invention there are no jumps of radius in the transition zone and in the mirror surface, and in particular none in the region of the run-out of the transition zone into the mirror surface. The compression rollers roll therefore more uniformly on the punch heads. Through this, the contact and thereby the force introduction by the compression rollers that act on the punch heads is made more uniform, and the wear on the punch head and the compression rollers is decreased. Moreover, less vibrations of the machine stand occur, so that noise emissions are reduced. By the very flat curve transition of the transition zone into the mirror surface, a high compression force is achieved by the acting compression rollers even already closely next to the mirror surface. This increases the effective pressure hold time of the punches, so that even materials that are difficult to compress can be processed reliably according to the present invention.

The mathematical function may be a polynomial function e.g., which may take on a constant value in the region of the mirror surface. The diameter of the head may be greater than 25 mm. However, smaller punch head diameters are also possible. The rotary press may be a tablet press in particular. In order to distribute the interaction of the punch head with the compression rollers even more uniformly, the course of the three-dimensional surface can be described in an arbitrary radial direction by the mathematical function that is continuous in its second derivative. Moreover, the punch head can be rotationally symmetric. This permits to install the compression punch into the rotary press in arbitrary rotational orientations.

According to a further embodiment, the radius of curvature of the three-dimensional surface can decrease continuously in the radial direction from the mirror surface towards the cylinder surface. Thus, the radius decreases in the radial direction, starting from the centre of the mirror surface. In the region of the mirror surface, the radius is infinite when the mirror surface is plane. Such an embodiment secures a particularly uniform contact with the compression rollers, and through this a particularly uniform build-up of pressure, so that noise emissions and wear are minimised further.

According to a further embodiment, a zone that is rounded with at least a given radius is provided between the transition zone and the cylinder surface. According to an alternative embodiment, at least one edge may also be provided between the transition zone and the cylinder surface. Thus, the transition from the transition zone into the cylinder surface is not continuous in the second derivative in these embodiments. The transition into the mirror surfaces is namely more important with respect to the interaction with the rollers, because the compression rollers act here. However, in order to make the interaction with the compression rollers more uniform even at compression punches that are installed in a greater distance, the three-dimensional surface described by the mathematical function that is continuous in its second derivative may also include the cylinder surface. In this case, the transition zone runs out directly into the mirror surface and into the cylinder surface as well. Thus, only the transition zone is provided between the mirror surface and the cylinder surface. The punch head may verge from the cylinder surface into the shaft preferably in a convex, particularly globular shape. A globular realisation of the punch head's lower side decreases the wear in the phase wherein the punch is pulled out of the respective die bore. In particular, the contact surface to the respective control cams is increased by the globular shape.

Besides, the present invention is related to a rotary press with a rotor which has an upper and a lower punch guiding device, in each of which a plurality of compression punches according to the present invention are guided, which co-operate with bores of a die plate that is arranged between the upper and the lower punch guiding device, wherein the punches are axially movable in guide bores of the punch guiding devices, and their punch heads co-operate with compression rollers of the rotary press in order to compress powder-shaped material in the die bores.

BRIEF DESCRIPTION OF THE SEVERAL VIEWS OF THE DRAWINGS

An example of the present invention's realisation will be explained in more detail by means of a drawing in the following.

DETAILED DESCRIPTION OF THE INVENTION

Figure 1:
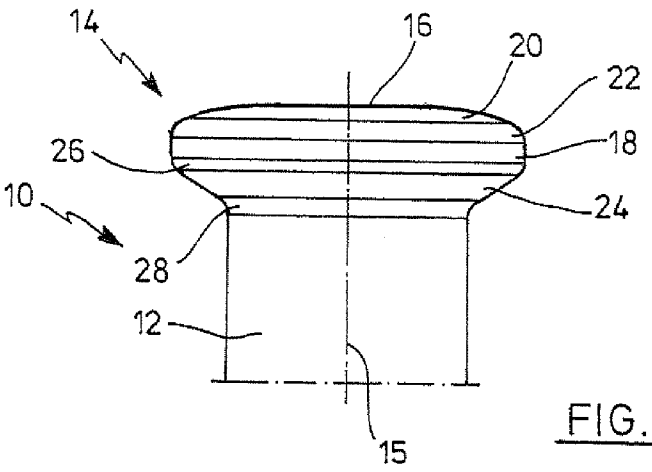
FIG. 1 shows schematically a compression punch of the present invention in a partial side view.

While this invention may be embodied in many different forms, there are described in detail herein a specific preferred embodiment of the invention. This description is an exemplification of the principles of the invention and is not intended to limit the invention to the particular embodiment illustrated.

As far as not indicated otherwise, same reference signs designate same objects in the figures. A cut-out of a compression punch 10 of the present invention is shown in a side view in FIG. 1. The upper end of the shaft 12 of the compressions punch 10 is shown with the punch head 14. A per se known compression region is provided at the not shown opposing end of the shaft 12, which co-operates with suitable die bores for compressing powder-shaped tablet material when the compression punch 10 is installed in a rotary press. The punch head 14 is rotationally symmetric, the rotational symmetry axis being shown in dashed lines at the reference sign 15. The punch head 14 has a mirror surface 16 that is flat at the upper side and circular in the top view. Besides, it has an outer cylinder surface 18. Between the cylinder surface 18 and the mirror surface 16, there is a curved transition zone 20. In the shown example, the mirror surface 16 and the transition zone 20 form a three-dimensional curved surface, whose course in an arbitrary radial direction of the punch head 14 is described by a mathematical function that is continuous in its second derivative. In particular, the radius of curvature of the three-dimensional surface decreases continuously towards the outside in the shown example, starting from the centre of the mirror surface 16. The height of the punch head 14 decreases also continuously, starting from the mirror surface 16 and towards the cylinder surface 18. Between the transition zone 20 and the cylinder surface 18, a zone 22 rounded with a given radius is provided. A convex transition zone 24, globular in the example, is provided at the lower side of the punch head 14 between the cylinder surface 18 and the shaft 12, which verges into the cylinder surface 18 via a first rounded zone 26 and verges into the shaft via a second rounded zone 28.

Figure 2:
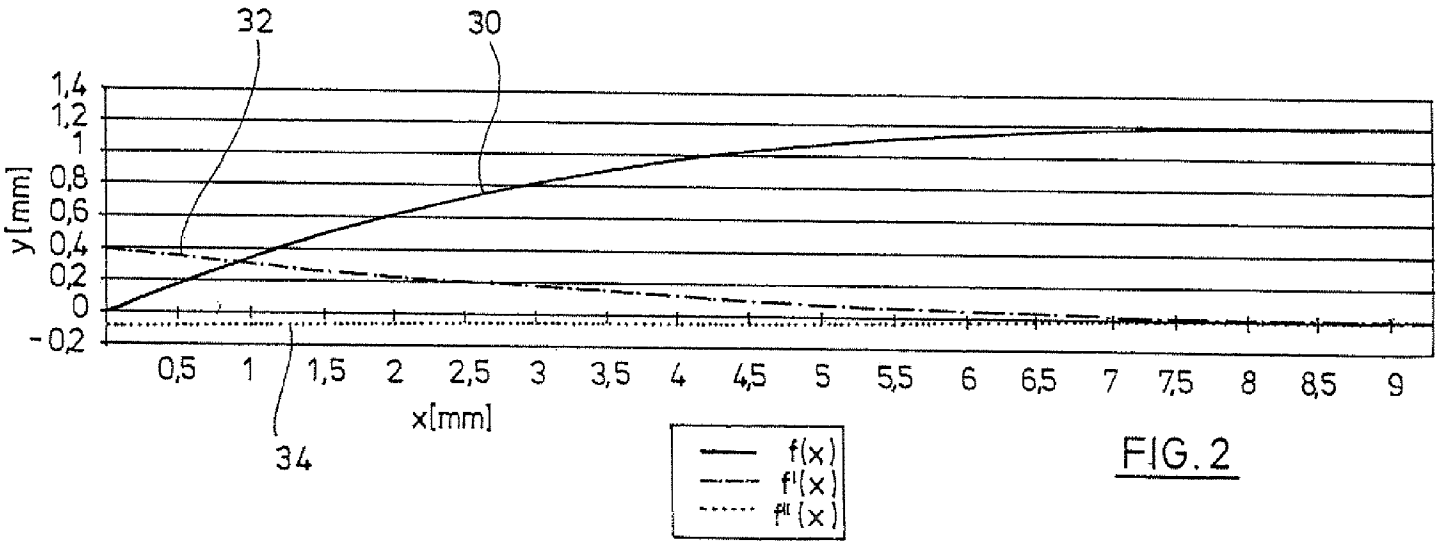
FIG. 2 shows schematically a diagram for the illustration of mathematical functions.

In FIG. 2, a mathematical function f(x) is shown at reference sign 30, which depicts the two-dimensional course of the transition zone 20 up to the mirror surface 16 in an arbitrary radial direction. It is dealt with a polynomial function of the following kind:

$$f(x)=a\cdot x^3-b\cdot x^2+c\cdot x,$$

wherein a, b and c are suitable constants whose value is determined depending on the desired geometrical shape of the punch head.

Above the values of the x-axis shown in FIG. 2, the function 30 may then be defined as being constant e.g., so that it maps the plane mirror surface. It must be noticed that in FIG. 2, the zero point of the coordinates was set to the lower edge of the three-dimensional surface formed by the transition zone 20 and the mirror surface 16. Thus, the y-axis represents the height of the punch head 14. In a rotation around a suitable axis, the function 30 shown in FIG. 2 correspondingly expands the three-dimensional surface formed by the transition zone 20 and the mirror surface 16. The first derivative f'(x) of the function f(x) is furthermore represented in dashed lines at reference sign 32 in the diagram in FIG. 2. Finally, the second derivative f"(x) of the function f(x) is represented in dashed lines at reference sign 34 in FIG. 2. It can be recognised that the second derivative f"(x) of the function f(x) is continuous.

The compression punch according to the present invention shown in FIG. 1 alleviates the noise emissions that occur in the contact with the compression rollers, as well as the wear of the punch head and the compression rollers when it is operated in a rotary press. Moreover, the very flat transition of the transition zone 20 into the mirror surface 16 results in an increased pressure hold time of the punches, so that even materials that are difficult to compress can be processed without problems.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A compression punch for a rotary press, with a shaft (12), a punch head (14) disposed at one shaft end and a compression zone disposed at the other shaft end, wherein the punch head (14) features an upper mirror surface (16), an outer cylinder surface (18) and a curved transition zone (20) between the mirror surface (16) and the cylinder surface (18), characterized in that the mirror surface (16) and the transition zone (20) form a three-dimensional surface, whose course in at least one radial direction can be described by a mathematical function (30) whose second derivative is continuous, and further characterized in that the radius of curvature of the three-dimensional surface decreases continuously in the radial direction from the mirror surface (16) to the cylinder surface (18).

2. A compression punch according to claim 1, characterized in that the course of the surface in an arbitrary radial direction is described by the mathematical function (30).

3. A compression punch according to claim 2, characterized in that the punch head (14) is rotationally symmetric.

4. A compression punch according to claim 1, characterized in that a zone (22) rounded with at least a given radius is provided between the transition zone (20) and the cylinder surface (18).

5. A compression punch according to claim 1, characterized in that the punch head (14) features a convex transition zone (24) from the cylinder surface (18) towards the shaft (12).

6. A rotary press with a rotor which has an upper and a lower punch guiding device, in each of which a plurality of compression punches (10) according to claim 1 are guided, which co-operate with bores of a die plate that is arranged between the upper and the lower punch guiding device, wherein the punches (10) are axially movable in guide bores of the punch guiding devices, and their punch heads (14) co-operate with compression rollers of the rotary press in order to compress powder-shaped material in the die bores.

7. A compression punch for a rotary press, with a shaft (12), a punch head (14) disposed at one shaft end and a compression zone disposed at the other shaft end, wherein the punch head (14) features an upper mirror surface (16), an outer cylinder surface (18) and a curved transition zone (20) between the mirror surface (16) and the cylinder surface (18), characterized in that the mirror surface (16) and the transition zone (20) form a three-dimensional surface, whose course in at least one radial direction can be described by a mathematical function (30) whose second derivative is continuous, and further characterized in that the radius of curvature of the three-dimensional surface decreases continuously in the radial direction from the mirror surface (16) to the cylinder surface (18), and further characterized in that at least one edge is provided between the transition zone (20) and the cylinder surface (18).

* * * * *